United States Patent [19]

Gray et al.

[11] Patent Number: 4,506,110

[45] Date of Patent: Mar. 19, 1985

[54] HIGH VOLTAGE CORONA SHIELD

[75] Inventors: Keith I. Gray, La Verne; Henry G. Meier, Glendale, both of Calif.

[73] Assignee: Brown Boveri Electric Inc., Rolling Meadows, Ill.

[21] Appl. No.: 569,515

[22] Filed: Jan. 9, 1984

Related U.S. Application Data

[62] Division of Ser. No. 336,636, Jan. 4, 1982, Pat. No. 4,442,329.

[51] Int. Cl.[3] ..... H01T 19/02

[52] U.S. Cl. ..... 174/144; 174/127

[58] Field of Search ..... 174/18, 31 R, 127, 140 CR, 174/142, 143, 144, 152 R, 153 R; 16/2, 108, 109; 24/141; 228/170, 173.4

[56] References Cited

U.S. PATENT DOCUMENTS 2,816,950 12/1957 Kruss et al. ..... 174/153 R

*Primary Examiner*—Laramie E. Askin

*Attorney, Agent, or Firm*—Ostrolenk, Faber, Gerb & Soffen

[57] ABSTRACT

A corona tube is provided wherein the tube is flexible so that it can fit on any three dimensional container rim. The tube can be a flexible steel tube which is a standard commercial variety of corrugated steel tube which is usually used to contain wires or the like. The tube has a slotted edge along its length, is cut to a length to the periphery of the rim and bent in the shape of the rim. The slot of the flexible tube is placed over the edge of the rim and thereafter the tube can be welded to the rim.

5 Claims, 1 Drawing Figure

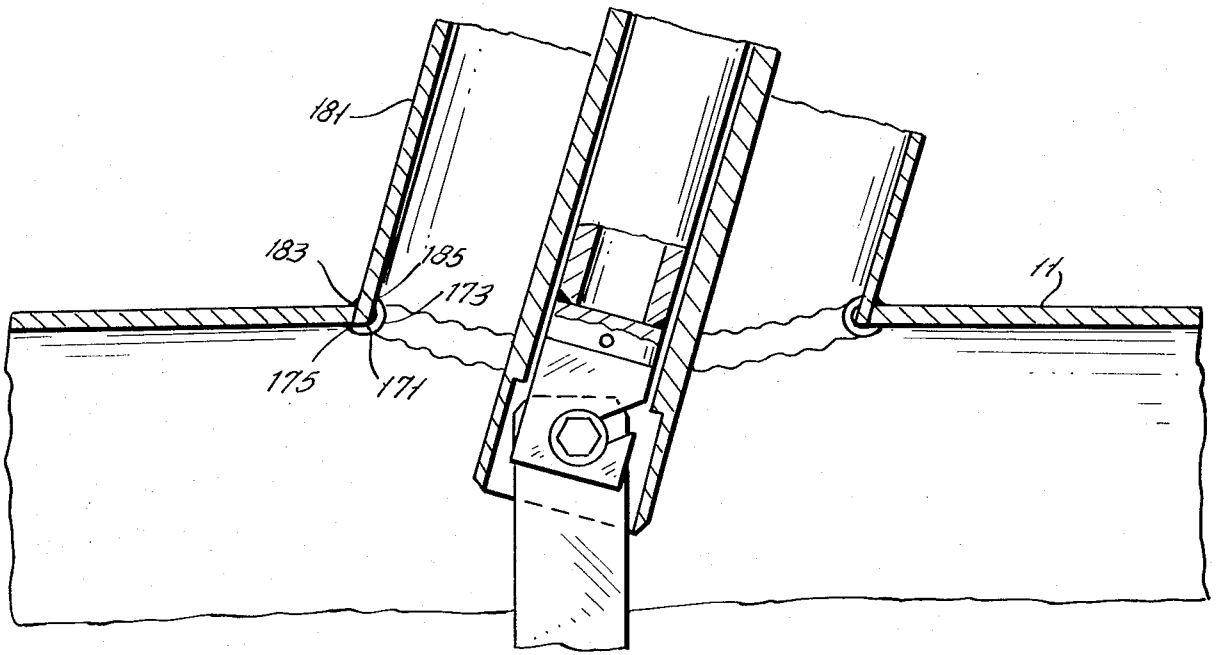
11
185
173
171
181
183
175

HIGH VOLTAGE CORONA SHIELD

RELATED APPLICATIONS

This is a divisional of U.S. patent application Ser. No. 336,636, filed Jan. 4, 1982 now issued as U.S. Pat. No. 4,442,329 on Apr. 10, 1984 assigned to the assignee of the present case.

SUMMARY OF THE INVENTION

A novel corona discharge prevention ring is formed of a flexible metal tube which is slotted along its length and then forced over and along the periphery of an opening in a tank through which a bushing conductor extends. This novel tube serves as an inexpensive corona ring around the sharp corners of the opening which receives the bushing. Since it is a flexible member which is readily commercially available, it can easily follow the shape of any surface on which it is fitted.

BRIEF DESCRIPTION OF THE DRAWING

The single FIGURE is a cross-sectional view showing the novel corona tube on the opening in the side of a hollow cylindrical tank.

DETAILED DESCRIPTION OF THE INVENTION

An opening 171 is formed in the cylinder 11 to permit access of a bushing conductor. Conventionally, the opening has sharp corners and it is preferred that the sharp corners be protected with corona shields in the form of beads or the like which eliminate or cover sharp corners which could initiate corona discharge.

In accordance with the present invention, a novel flexible steel tube 173 is provided which is of a standard commercial variety of corrugated steel tubes which is flexible and has been used to contain wires or the like.

In accordance with the invention, this flexible tube 173 is cut to length and slotted along its length. The slotted side is forced over the opening 171 as shown for the tube 173. The tube 173 is pre-cut to a length which is equal to the periphery of the opening 171. In this manner, an extremely inexpensive corona shield is formed around the opening 171.

The side of the tube 173 interiorly of cylindrical member 11 may be tack-welded or otherwise held to the inside of the member 11 as by the weld 175.

A conductive cylindrical throat 181 for a bushing is welded around the opening 171 as at the weld 183. The tube 181 is cut to appropriate shapes and welded to the tank body 11 at the opening 171. The corona shield tube 173 is then welded to the interior of member 181 as shown by the weld 185. The novel corona shield formed by the slotted flexible conductive tube 173 can, of course, be applied to any sharp edge which must receive some type of corona bead or ring.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A corona shield structure and an elongated rim of a conductive plate; said rim having a sharp peripheral edge which would create a high enough dielectric stress adjacent said edge in the presence of a high electric field to cause corona discharge at said rim before causing discharge in regions removed from said rim; said corona shield structure comprising an elongated hollow flexible metal corrugated tube having an elongated slot in its wall; said rim being disposed within said slot for the length of said rim which is subject to corona discharge, whereby said tube is electrically connected to said rim and produces a greater curvature for corona purposes than said sharp edge would have produced.

2. The structure of claim 1 wherein said metal tube is welded to said plate.

3. The structure of claim 1 or 2 wherein said rim is a circular rim defining an opening in said conductive plate.

4. A cylindrical metal housing having a generally circular opening on the side thereof; said opening having relatively sharp peripheral edges which would create high dielectric stress adjacent said edges in the presence of a high electric field; a corona shield for the edges of said opening; said corona shield comprising a hollow flexible metal corrugated tube; said tube having a length equal to the periphery of the opening, and being bent to the shape of the opening; said tube having a slot in its outer periphery; said peripheral edges of said opening being received in the slot of the flexible tubular corona shield.

5. The combination of claim 4 wherein said corona shield is welded to the housing around the periphery of the opening.

* * * * *